US008235384B2

(12) United States Patent
Matsumoto

(10) Patent No.: US 8,235,384 B2
(45) Date of Patent: Aug. 7, 2012

(54) SHEET-MATERIAL TRANSPORTING DEVICE AND IMAGE FORMING APPARATUS

(75) Inventor: Tadashi Matsumoto, Adachi-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 651 days.

(21) Appl. No.: 11/417,612

(22) Filed: May 4, 2006

(65) Prior Publication Data

US 2006/0263113 A1 Nov. 23, 2006

(30) Foreign Application Priority Data

May 17, 2005 (JP) ..... 2005-143552

(51) Int. Cl.
*B65H 29/30* (2006.01)

(52) U.S. Cl. ..... 271/193

(58) Field of Classification Search ..... 271/193; 399/303, 313; 198/688.1, 608, 690.1
See application file for complete search history.

(56) References Cited

U.S. PATENT DOCUMENTS

| | | | | |
|---|---|---|---|---|
| 5,531,436 | A | 7/1996 | Ohyama | |
| 5,881,339 | A * | 3/1999 | Yanagida et al. | 399/101 |
| 5,907,758 | A * | 5/1999 | Tanaka et al. | 399/303 |
| 6,332,612 | B1 * | 12/2001 | Kanemura | 271/275 |
| 6,375,184 | B1 | 4/2002 | Hayashi | |
| 6,511,172 | B2 * | 1/2003 | Tanno et al. | 347/104 |
| 6,595,515 | B2 * | 7/2003 | Numata et al. | 271/193 |
| 6,857,802 | B2 * | 2/2005 | Chino et al. | 400/635 |
| 2002/0021312 | A1 | 2/2002 | Matsumoto | |

FOREIGN PATENT DOCUMENTS

| | | |
|---|---|---|
| CN | 1131787 | 1/2002 |
| JP | 08-292655 | 11/1996 |
| JP | 11-151842 | 6/1999 |
| JP | 2000-060168 A | 2/2000 |
| JP | 2000-247476 A | 9/2000 |
| JP | 2001-039569 | 2/2001 |
| JP | 2003-237973 | 8/2003 |

* cited by examiner

*Primary Examiner* — Stefanos Karmis
*Assistant Examiner* — Thomas Morrison
(74) *Attorney, Agent, or Firm* — Canon USA Inc IP Division

(57) ABSTRACT

A sheet-material transporting device includes a transporting belt configured to attract a sheet material and transport the sheet material along a transporting direction, the transporting belt including a plurality of electrodes arranged at predetermined intervals along the transporting direction, wherein the electrodes are sized and shaped extending in a direction intersecting the transporting direction; a pressing roller configured to press the sheet material against an attraction starting position of the transporting belt; and a charging unit configured to apply a voltage to the electrodes. The sheet-material transporting device is characterized in that the sheet material is attracted to the transporting belt after the leading edge of the sheet material is pressed against the transporting belt by the pressing roller, or the charging unit is configured such that the voltage is not applied upstream of a nip of the pressing roller in the transporting direction.

18 Claims, 16 Drawing Sheets

SHEET-MATERIAL TRANSPORTING DEVICE AND IMAGE FORMING APPARATUS

BACKGROUND OF THE INVENTION

1. Field of the Invention

The present invention relates to a sheet-material transporting device for transporting sheet material while allowing the sheet material to be attracted to a transporting belt, and further relates to an image forming apparatus including the sheet-material transporting device.

2. Description of the Related Art

Image forming apparatuses, such as printers, copiers, and facsimiles, form an image composed of a pattern of dots on sheet material (i.e., a recording medium such as paper or a thin plastic sheet) on the basis of image information. Such image forming apparatuses can be divided, according to their recording method, into several types, including an inkjet type, a wire dot type, a thermal type, and a laser beam type. Of these types of image forming apparatuses, an inkjet-type image forming apparatus is configured to eject ink from a recording head onto sheet material, such as recording paper, thereby forming an image on the sheet material. The inkjet-type image forming apparatus facilitates the compactness of the recording head, and can provide high-definition images at high speed and low running cost. Moreover, the inkjet-type image forming apparatus, which is a non-impact type apparatus, produces less noise and can easily record color images with multicolor ink. In particular, with a full-line type recording apparatus including a line-type recording head having many orifices arranged across the paper width, it is possible to further increase the speed of recording.

Generally, an image forming apparatus transports sheet material from a paper feed unit (e.g., a paper cassette), through an image forming unit (recording unit), to a paper ejecting unit. The transport of the sheet material is controlled at predetermined timing throughout the process from paper feeding, through image formation, to paper ejection. The process from paper feeding to image formation particularly requires accurate transport, as an image forming position on the sheet material will be affected. Moreover, during image formation, if the sheet material is not transported at a constant speed, a deviation in image scaling factor occurs and causes undesirable expansion or contraction of an image. In particular, for an image forming apparatus with a plurality of recording heads, a displacement between images recorded by the plurality of different recording heads occurs. In the case of a color image forming apparatus, this displacement appears as a color displacement and causes image defects. To prevent such problems, it is necessary to accurately transmit the transporting force of a precisely controlled transporting unit to the sheet material.

An example of transporting systems proposed in view of the above-described aspects is a transporting device that includes an endless belt and using an electrostatic attraction force to bring sheet materials into close contact with the endless belt. For such a belt-type transporting device using an electrostatic attraction force, and particularly for a color image forming apparatus with a plurality of recording heads (image forming units), it is necessary to precisely maintain the transporting speed of the belt for accurate adjustment of an image forming position for each recording head. It is also necessary to hold sheet material in close contact with a transporting member (such as a belt or a drum) so that the sheet material on the transporting member can be prevented from floating or being displaced.

However, in an image forming apparatus, such as a color image forming apparatus with a plurality of long full-line type recording heads extending in a direction intersecting the transporting direction, a distance from a recording head on the uppermost stream side to that on the lowermost stream side is very long. This causes flapping of sheet material in a recording area and may result in distortion in recorded images and paper jams. A method proposed for urging sheet material downward to prevent it from floating is to apply a voltage to electrodes included in a transporting belt to generate an electric force, thereby causing the sheet material to be attracted to the transporting belt. Other proposed methods include a method in which an electrostatic attraction force is used to cause sheet material to be attracted to the transporting belt, and a method in which a pressure control chamber is provided to regulate pressure by a fan, thereby attracting sheet material to the transporting belt.

Japanese Patent Laid-Open No. 2000-247476 and Japanese Patent Laid-Open No. 2000-60168 discuss the above-described methods in which sheet material is transported while being attracted to the transporting belt in the recording area, and is subjected to recording performed by the recording head.

However, the above-described techniques present technical challenges to be solved. For example, in a method in which an electrostatic attraction force is used, it can be difficult to generate an attraction force sufficient for reducing cockling. Moreover, a variation in electrical characteristics caused by image formation can make it difficult to maintain a stable attraction force. In a transporting device using the other attracting method described above, since sheet material is attracted solely at an opening, and not attracted by an attraction-force generating unit provided over an extensive area, it can be difficult to attract an end portion of the sheet material. Moreover, it may be possible that the attraction of air causes image degradation, because air passing through sheet material may contain ink mist and cause ink spots on the sheet material.

On the other hand, a transporting device using an electrostatic attraction force described above is configured such that the uppermost stream end of a charging brush is located at substantially the same position, in the transporting direction, as that of the nip of a pressing roller for pressing sheet material against a transporting belt. As a result, there may be cases where sheet material transported from correction rollers for aligning the edges of the sheet material and compensating for the skew thereof is attracted to the transporting belt before it reaches the pressing roller. This may cause a deviation in attraction-force generation timing between the correction rollers and the pressing roller and cause skew to occur again at the leading edge of the sheet material.

In general, some pieces of sheet material are warped in a direction intersecting the transporting direction. When sheet material is warped upward in the middle, if an attraction force from a transporting belt is exerted on the sheet material before the sheet material reaches the nip of the pressing roller, both sides of the sheet material are first attracted to the transporting belt. As a result, the sheet material is pressed against the transporting belt by the pressing roller with the middle of the sheet material floating, and wrinkles occur in the middle of the sheet material.

SUMMARY OF THE INVENTION

The present invention is directed to a sheet-material transporting device capable of transporting sheet material with high precision while allowing the sheet material to be firmly attracted to a transporting belt. The present invention is also directed to an image forming apparatus including the sheet-material transporting device, and thus being capable of preventing degradation in image quality due to the occurrence of dot shift or the like and producing stable and high quality images.

According to an aspect of the present invention, a sheet-material transporting device includes a transporting belt configured to attract a sheet material and transport the sheet material along a transporting direction, the transporting belt including a plurality of electrodes arranged at predetermined intervals along the transporting direction, wherein the electrodes are sized and shaped extending in a direction intersecting the transporting direction; a pressing roller configured to press the sheet material against an attraction starting position of the transporting belt; and a charging unit configured to apply a voltage to the electrodes, wherein the sheet material is attracted to the transporting belt after the leading edge of the sheet material is pressed against the transporting belt by the pressing roller.

According to another aspect of the present invention, a sheet-material transporting device includes a transporting belt configured to attract a sheet material and transport the sheet material along a transporting direction, the transporting belt including a plurality of electrodes arranged at predetermined intervals along the transporting direction, wherein the electrodes are sized and shaped extending in a direction intersecting the transporting direction; a pressing roller configured to press the sheet material against an attraction starting position of the transporting belt; and a charging unit configured to apply a voltage to the electrodes, wherein the charging unit is configured such that the voltage is not applied upstream of a nip of the pressing roller in the transporting direction.

According to the present invention, an attraction force is not exerted on the sheet material at a point upstream of the pressing roller in the transporting direction. Therefore, it is possible to provide a sheet-material transporting device capable of transporting sheet material with high precision while allowing the sheet material to be firmly attracted to a transporting belt. It is also possible to provide an image forming apparatus including the sheet-material transporting device, and thus capable of preventing degradation in image quality due to the occurrence of dot shift or the like and producing stable and high quality images.

Further features of the present invention will become apparent from the following description of exemplary embodiments with reference to the attached drawings.

DESCRIPTION OF THE EMBODIMENTS

Figure 1:
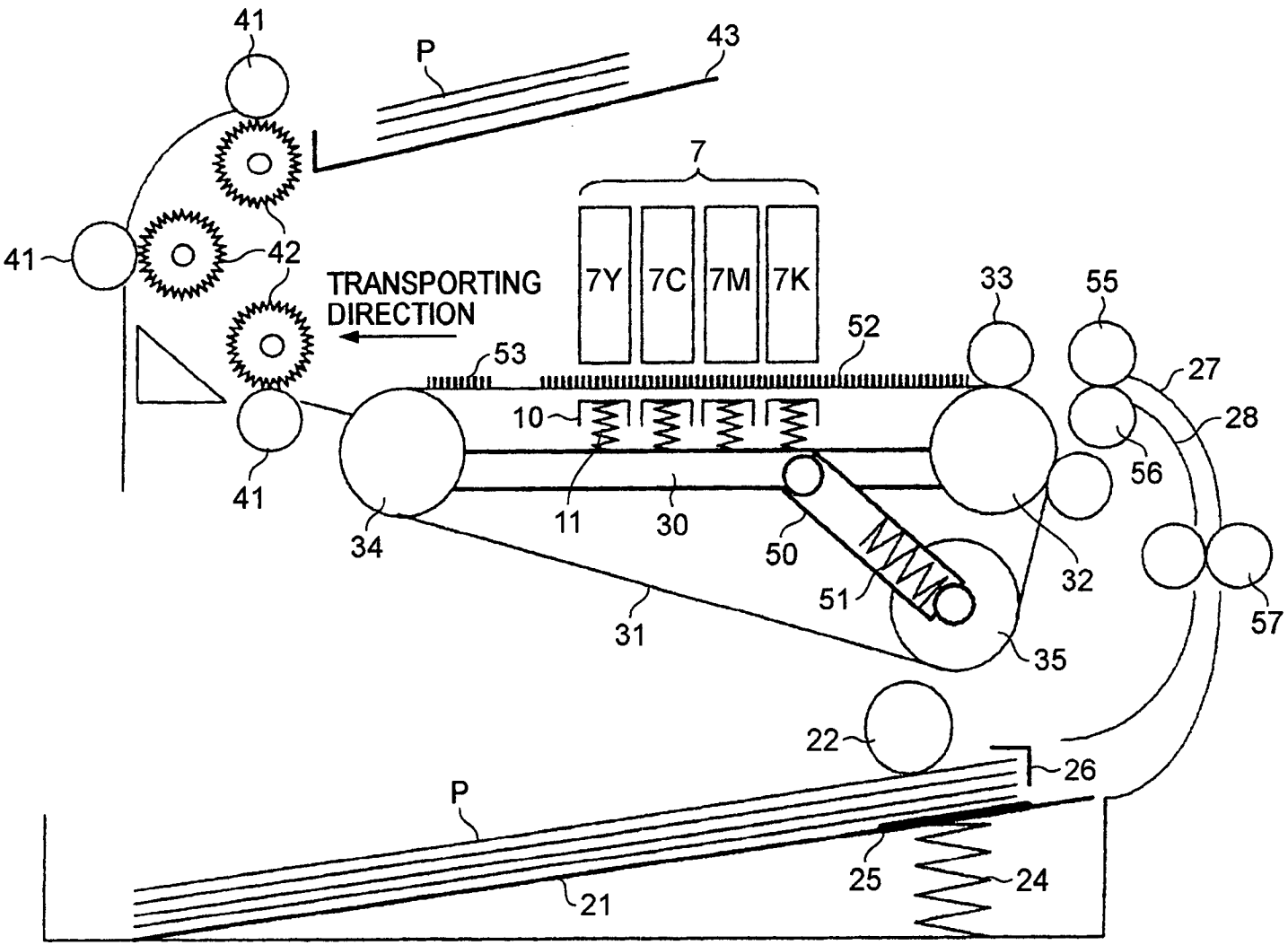
FIG. 1 is a schematic vertical cross-sectional view illustrating a configuration of at least one exemplary embodiment of an image forming apparatus including a sheet-material transporting device according to the present invention.
Figure 2:
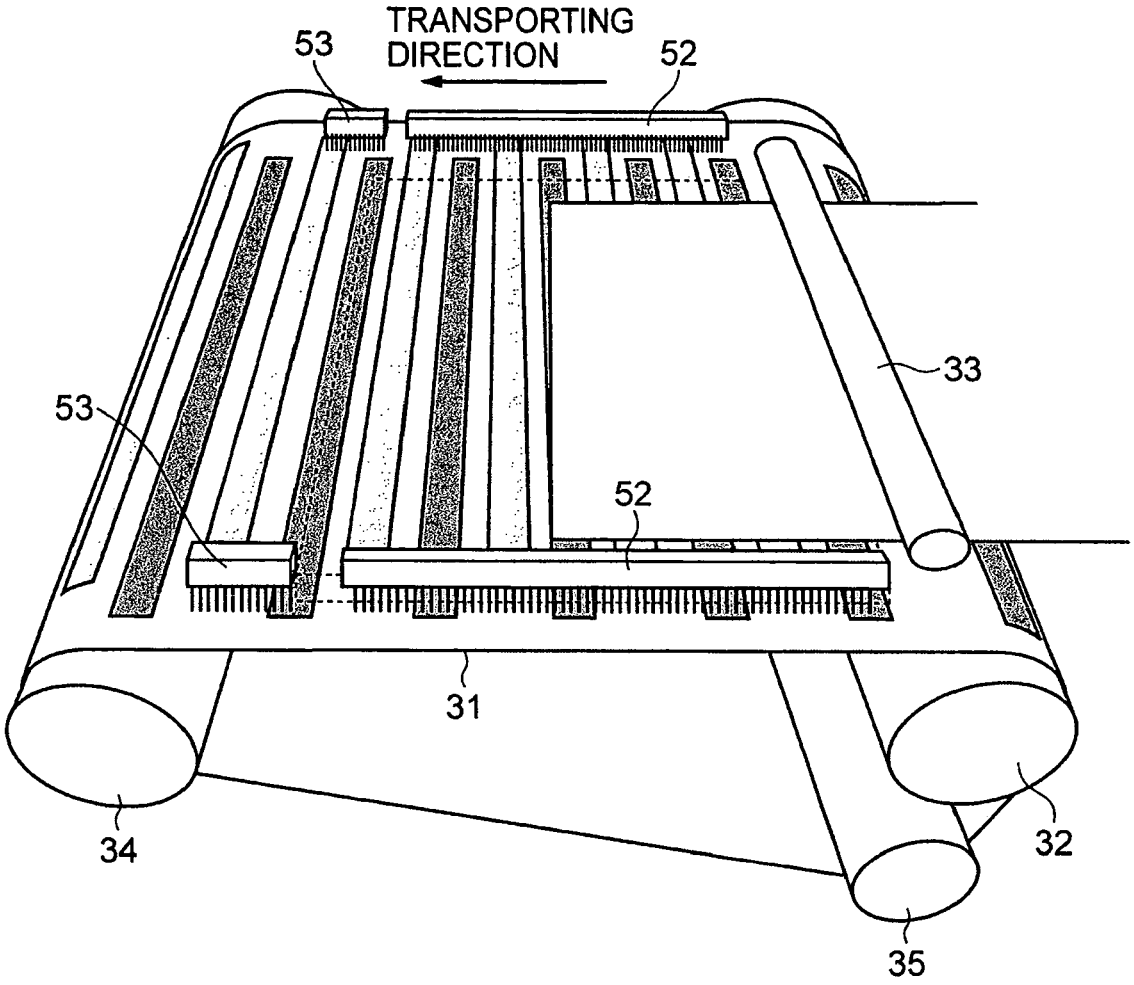
FIG. 2 is a schematic perspective view illustrating a first exemplary embodiment of the sheet-material transporting device in FIG. 1.
Figure 3:
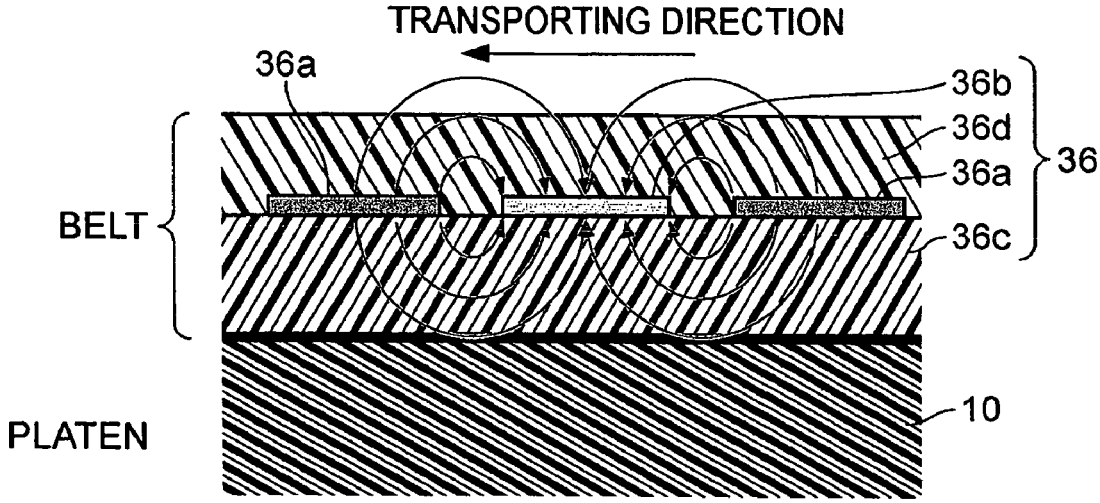
FIG. 3 is a schematic partial vertical cross-sectional view of a transporting belt and a platen under the transporting belt taken along a transporting direction and illustrating a mechanism for generating an attraction force.
Figure 4:
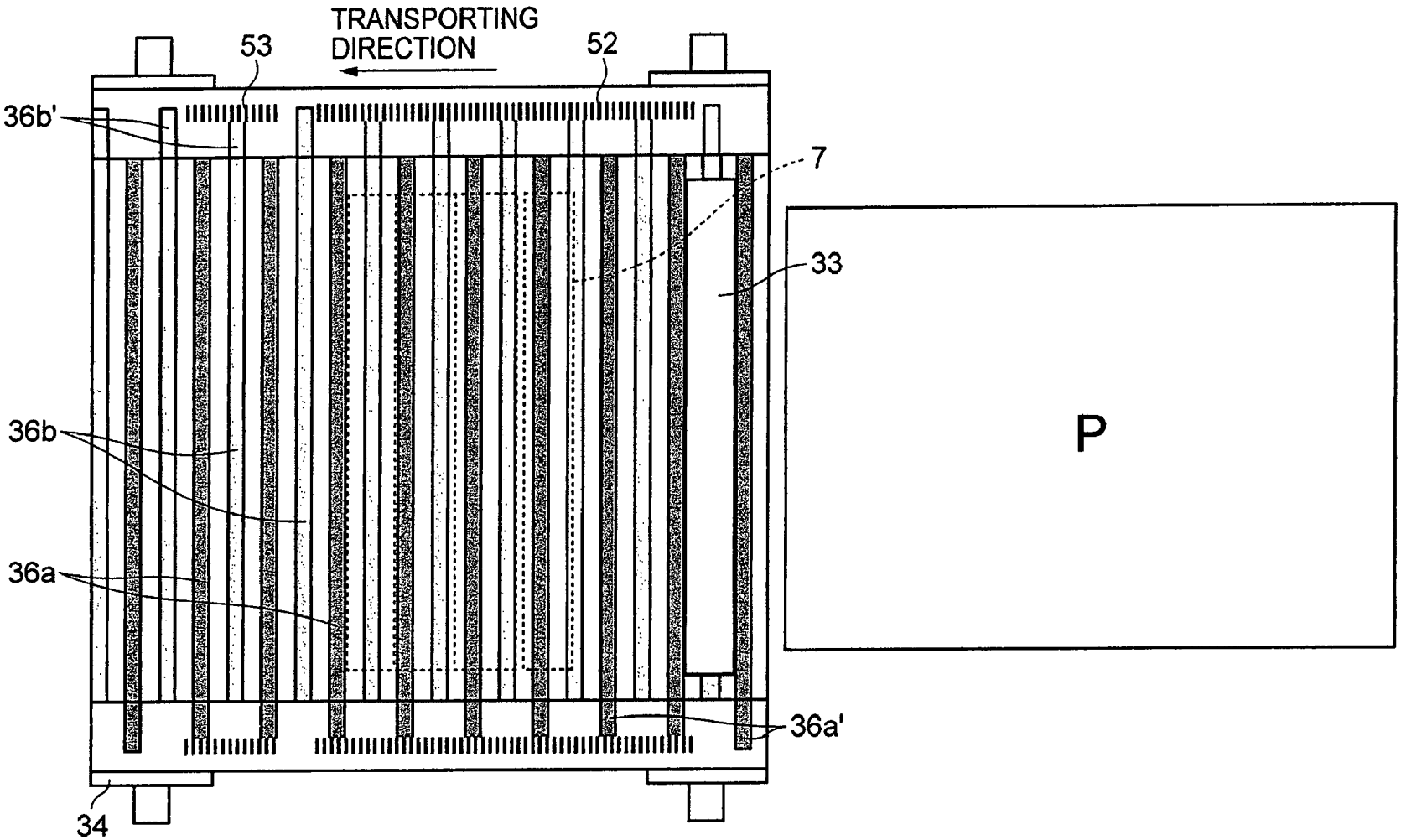
FIG. 4 is a schematic plan view illustrating the first exemplary embodiment of the sheet-material transporting device according to the present invention.
Figure 5:
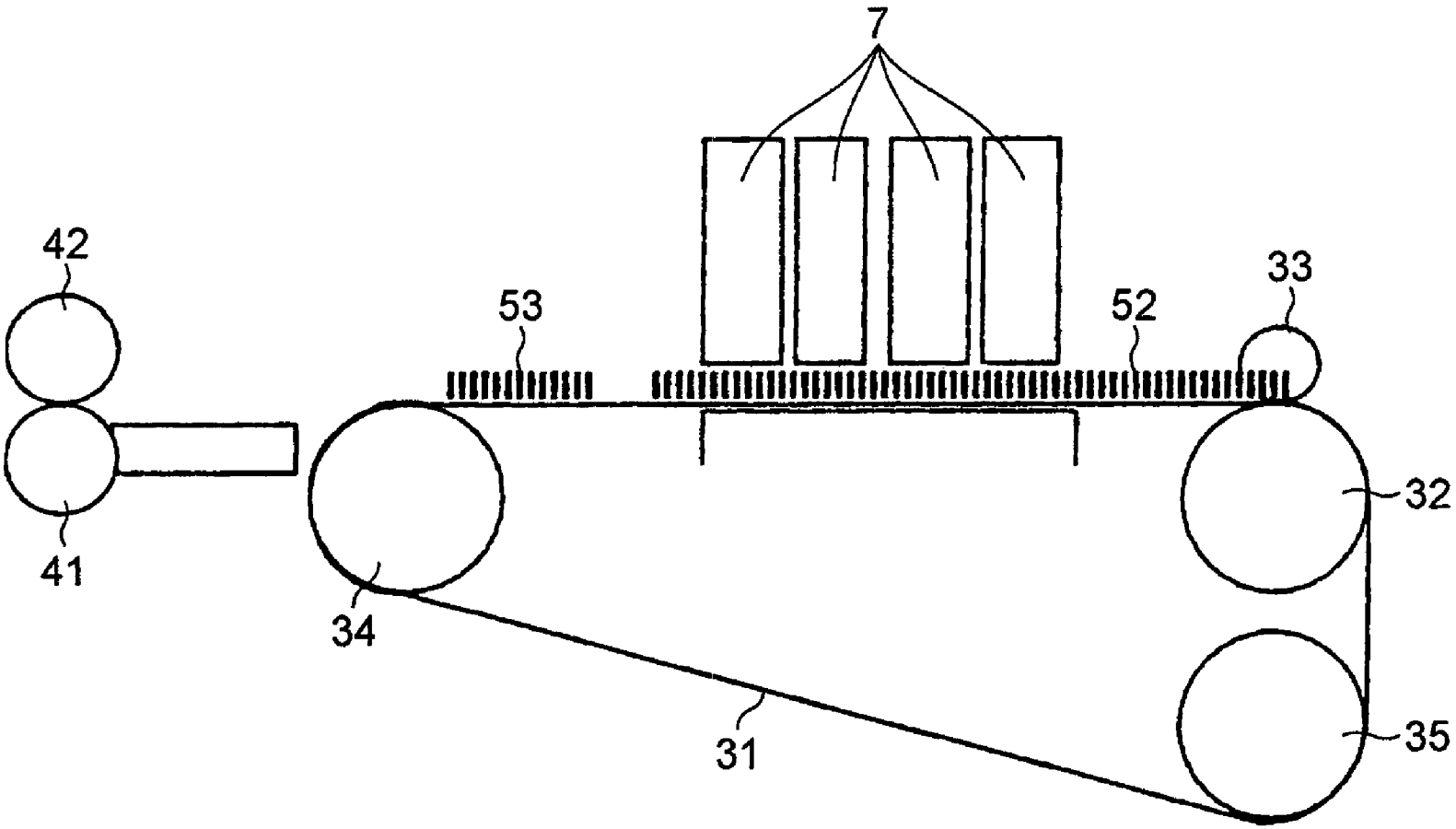
FIG. 5 is a schematic side view of the sheet-material transporting device illustrated in FIG. 4.

Exemplary embodiments of the present invention will now be described in detail with reference to the drawings. Notice that the same reference numerals in the drawings refer to the same or corresponding items. FIG. 1 is a schematic vertical cross-sectional view illustrating a configuration of at least one exemplary embodiment of an image forming apparatus including a sheet-material transporting device according to the present invention. FIG. 2 is a schematic perspective view illustrating a first exemplary embodiment of the sheet-material transporting device in FIG. 1. FIG. 3 is a schematic partial vertical cross-sectional view of a transporting belt and a platen under the transporting belt taken along a transporting direction and illustrating a mechanism for generating an attraction force. FIG. 4 is a schematic plan view illustrating the first exemplary embodiment of the sheet-material transporting device according to the present invention. FIG. 5 is a schematic side view of the sheet-material transporting device illustrated in FIG. 4.

The configuration and operation of each part of an image forming apparatus including a sheet-material transporting device according to at least one exemplary embodiment will be described with reference to FIG. 1 to FIG. 5. Referring to FIG. 1, in a paper feed unit, driving a thick plate 21 loaded with sheet material P (recording media) and a feed roller 22 for feeding the sheet material P starts a paper feed operation. The thick plate 21 is rotatable about a rotation axis and is biased by a thick plate spring 24 toward the feed roller 22. The thick plate 21 is provided with a separation pad 25 facing the feed roller 22. The separation pad 25 prevents double feeding the sheet material P and can be made of, for example, artificial leather having a large friction coefficient. Corners on one side of the sheet material P are covered with separation pawls 26 for separating the sheet material P into individual sheets. The thick plate 21 is brought into contact with and released from the feed roller 22 by a release cam (not shown).

In standby mode, the release cam holds the thick plate 21 at a predetermined position such that the thick plate 21 and the sheet material P thereon are separated from the feed roller 22. When the feed roller 22 and the release cam are driven in this state, the release cam is separated from the thick plate 21 and allows the thick plate 21 to move upward. This brings the sheet material P into contact with the feed roller 22. As the feed roller 22 rotates, a piece of the sheet material P is picked up, separated by the separation pawls 26, and fed to a belt transporting unit. The feed roller 22 continues rotating until the piece of the sheet material P is fed to the belt transporting unit. When the standby mode in which the feed roller 22 is separated from the sheet material P is entered again, the driving force of the feed roller 22 is cut off.

The belt transporting unit is composed of a sheet-material transporting device including a transporting belt 31 that attracts and transports the sheet material P. The transporting belt 31 is driven by a driving roller 34 and wound by a driven roller (transporting roller) 32 and a tension roller 35. The driven roller 32 and the driving roller 34 are rotatably attached to a frame 30. The tension roller 35 is rotatably attached to an end of an arm 50, whose other end is swingably attached to the frame 30. A spring 51 biases the tension roller 35 outward to apply a tension to the transporting belt 31.

A recording head assembly 7 for forming (recording) an image on the sheet material P is provided above a horizontal surface of the transporting belt 31, which can be an endless belt. The recording head assembly 7 faces platens 10 with the transporting belt 31 interposed therebetween. In the present exemplary embodiment, the recording head assembly 7 serving as a recording unit includes four recording heads for color recording, that is, recording heads 7K, 7M, 7C, and 7Y for black, magenta, cyan, and yellow, respectively. In a recording unit, the platens 10 for supporting the sheet material P in a horizontal state are disposed under the transporting belt 31 and directly below their corresponding recording heads 7K, 7M, 7C, and 7Y. The platens 10 are arranged on their corresponding platen springs 11 provided on the frame 30. The platens 10 are biased to be in contact with a reference position member (not shown) of the recording head assembly 7 so that the positional accuracy of the platens 10 is ensured. While limiting the downward displacement of the transporting belt 31, the platens 10 precisely guide the transporting belt 31.

A pressing roller 33 is disposed above the driven roller 32 and faces the driven roller 32 with the transporting belt 31 interposed therebetween. The pressing roller 33 presses the sheet material P against the transporting belt 31 at an attraction starting position. Since the transporting belt 31 is introduced into the nip between the driven roller 32 and the pressing roller 33, the pressing roller 33 rotates as the driven roller 32 rotates. The pressing roller 33 is pressed against the transporting belt 31 by a spring (not shown) and rotates together with the driven roller 32 to guide the sheet material P to the recording head assembly 7. In the transporting path for the sheet material P, a pair of rollers (correction rollers) 55 and 56 is provided upstream of the transporting belt 31 in the transporting direction. At the leading edge of the sheet material P, the correction rollers 55 and 56 correct for the skew of the sheet material P fed from the paper feed unit. The recording head assembly 7 serving as an image forming unit is provided downstream of the driven roller 32 in the transporting direction. On the basis of image information, the recording head assembly 7 forms an image on the sheet material P transported by the transporting belt 31.

In the configuration described above, the sheet material P transported from the correction rollers 55 and 56 toward the belt transporting unit (i.e., a sheet-material transporting section of the transporting belt 31) is introduced into the nip between the driven roller 32 and the pressing roller 33 at rest and applied a transporting force for a predetermined period of time. The skew of the sheet material P is thus corrected. Then, an image forming position on the sheet material P is determined on the basis of the timing at which the correction rollers 55 and 56 start rotating (i.e., the timing at which the transport of the sheet material P starts). A transporting motor drives the driving roller 34 to cause the transporting belt 31 to run, thereby transporting the sheet material P from right to left in FIG. 1 and FIG. 2.

As illustrated in FIG. 3, the transporting belt 31 includes an attraction-force generating unit 36 for attracting and transporting the sheet material P. The attraction-force generating unit 36 includes positive electrodes (electrode plates) 36*a* and negative electrodes (electrode plates) 36*b* that can be made of conductive metal and embedded in the transporting belt 31. In other words, the transporting belt 31 includes the plurality of electrodes 36*a* and 36*b* alternately arranged at predetermined intervals in the transporting direction. As illustrated in FIG. 2 and FIG. 4, a voltage receiving portion 36*a*' is provided at an end of each positive electrode 36*a*, and a voltage receiving portion 36*b*' is provided at an end of each negative electrode 36*b*. Positive and negative voltages are applied from charging brushes (charging units) 52 disposed above both sides of the transporting belt 31, through the voltage receiving portions 36*a*' and 36*b*', to the electrodes 36*a* and 36*b*. This produces an electrostatic attraction force on the sheet material P. The sheet material P is transported while being held in close contact with the transporting belt 31 by the attraction force. During the transport, the recording head assembly 7 forms an image on the sheet material P.

The recording head assembly 7 includes the four long line-type recording heads 7K, 7M, 7C, and 7Y extending in a direction intersecting the transporting direction of the sheet material P and arranged in parallel in the transporting direction. These recording heads 7K, 7M, 7C, and 7Y are arranged at predetermined intervals, in this order from the upstream of the transporting direction, and attached to a head holder (not shown). Each of the recording heads 7K, 7M, 7C, and 7Y of the present exemplary embodiment is an inkjet recording head from which ink is ejected onto the sheet material P on the basis of image information. Each line-type inkjet recording head has an orifice face that faces the sheet material P at a predetermined distance therefrom and is provided with many orifices arranged over a recording area extending in a direction intersecting the transporting direction.

The recording heads 7K, 7M, 7C, and 7Y are configured such that a heater disposed inside each of their orifices supplies ejection energy to ink. The heat generated by the heaters causes film boiling in the ink inside the orifices. The film boiling then causes bubbles to expand or contract and varies the pressure of the ink. This allows the ink to be ejected from the orifices, thereby allowing an image to be formed on the sheet material P. The head holder is provided in a vertically movable manner such that it can be stopped precisely at a predetermined height from four ball-threaded shafts located on the left, right, front, and back. Head caps for covering orifices in a non-recording mode are arranged between a position immediately below the recording head assembly 7 (capping position) and a retracted position for the recording head assembly 7. The head caps are arranged in such a manner that they can be moved in parallel by a driving unit (not shown). In the non-recording mode, the head holder is raised, while the head caps are moved to the position immediately below the recording head assembly 7 such that the orifice faces are covered with the head caps. This allows for long-term storage of ink while keeping the ink from drying out.

Referring to FIG. 1, a paper ejecting unit is configured such that a piece of sheet material P separated from the belt transporting unit is ejected outside the image forming apparatus. Discharge brushes 53 serving as an electricity removing unit are disposed above both sides of the transporting belt 31 and downstream of the recording head assembly 7 (downstream of the charging brushes 52). After electricity on the sheet material P transported through the recording unit is removed by the discharge brushes 53, the sheet material P is subjected to self stripping on a separation plate, and guided to the paper ejecting unit. The paper ejecting unit includes paper-ejection roller sets (three sets are provided in the present exemplary embodiment), each set including a paper ejection roller 41 and a spur roller 42. The sheet material P on which an image has been formed by the recording head assembly 7 is transported while being held in the nip of each paper-ejection roller set, and ejected onto an output tray 43. Torque transmitted from the driving roller 34 causes the paper ejection rollers 41 to be driven in synchronization with the driving roller 34. Each spur roller 42 has sharp teeth on the outer edge so that ink on the sheet material P can be prevented from being transferred thereto.

Referring to FIG. 4, the voltage receiving portions 36*a*' of the plurality of positive electrodes 36*a* are arranged on one side of the transporting belt 31 along the transporting direction, and the voltage receiving portions 36*b*' of the plurality of negative electrodes 36*b* are arranged on the other side of the transporting belt 31 along the transporting direction. The voltage receiving portions 36*a*' and 36*b*' are exposed on the upper surface of the transporting belt 31 on the respective sides. The electrodes 36*a* and 36*b* are alternately arranged at predetermined intervals in the transporting direction. The voltage receiving portions 36*a*' of the positive electrodes 36*a* are located on the lower side (in the drawing), and thus, the conductive charging brush 52 and the discharge brush 53 located on the lower side (in the drawing) can be brought into contact with the voltage receiving portions 36*a*' by the application of a predetermined pressure. Likewise, the voltage receiving portions 36*b*' of the negative electrodes 36*b* are located on the upper side (in the drawing), and thus, the conductive charging brush 52 and the discharge brush 53 located on the upper side (in the drawing) can be brought into contact with the voltage receiving portions 36*b*' by the application of a predetermined pressure.

From a high voltage power source (not shown), a positive voltage is applied through the charging brush 52 to the voltage receiving portions 36*a*' of the electrodes 36*a*, while a negative voltage is applied through the other charging brush 52 to the voltage receiving portions 36*b*' of the electrodes 36*b*. FIG. 3 is a partial vertical cross-sectional view taken along the transporting direction and illustrating a part of the transporting belt 31 including the electrodes 36*a* and 36*b* and a part of the platen 10 under the transporting belt 31. Referring to FIG. 3, the electrodes 36*a* and 36*b* are interposed between a base layer 36*c* and a surface layer 36*d* and are protected thereby. The base layer 36*c* and the surface layer 36*d* can be made of plastic, such as polyethylene or polycarbonate.

In FIG. 3, the application of a voltage to the positive electrodes 36*a* causes an electric force to be generated in the directions of arrows, which represent the lines of electric force. A potential difference between the positive electrodes 36*a* and the negative electrodes (earth plates) 36*b* causes an electrostatic attraction force to be generated above the transporting belt 31. The sheet material P is thus attracted to the surface of the transporting belt 31 by the electrostatic attraction force. Electric charges (surface potentials) having the same polarity as that of the voltage applied to the positive electrodes 36*a* are generated on the recording surface of the sheet material P attracted to the transporting belt 31.

The attraction force exerted on the sheet material P is weakest at portions corresponding to an area located between the positive electrode 36*a* and an adjacent negative electrode 36*b* and provided with no conductive metal. For example, the charging brushes 52 having a moderate resistance of about $1\times10^6$ ohm-cm applies a voltage of about 0.5 kV to 10 kV to the attraction-force generating unit 36 to cause an attraction force to be generated on the transporting belt 31. In this case, varying the length and position (in the transporting direction) of the charging brushes 52 can vary a power feed area on the transporting belt 31, thereby controlling a sheet-material attracting area (attraction-force generating area).

A large amount of ink ejected onto the sheet material P causes the sheet material P to swell and then cockle (wave). However, since the sheet material P is attracted to the surface of the transporting belt 31 by the attraction-force generating unit 36, floating of the sheet material P toward the recording head assembly 7 can be prevented (eliminated). Therefore, even in the case where a line-type recording unit is used, undesirable contact between the sheet material P and the recording heads 7K, 7M, 7C, and 7Y can be prevented, and stable and good recording performance can be ensured. Since cockling of the sheet material P occurs in separate portions corresponding to areas where, in the transporting belt 31, the attraction force is weakest (i.e., the separate portions each corresponding to areas located between a positive electrode 36*a* and the adjacent negative electrode (earth electrode) 36*b* and provided with no conductive metal), floating of the sheet material P toward the recording head assembly 7 can be minimized.

Even if changes in the environment, such as temperature and humidity, cause cockling and curling on the edges, the sheet material P can be attracted to the transporting belt 31 with the cockling and curling eliminated by the pressing roller 33. The recording head assembly 7 thus achieves stable performance in image recording.

Therefore, in the present exemplary embodiment, the discharge brushes 53 that remove electricity from the electrodes 36*a* and 36*b* for separating the sheet material P from the transporting belt 31 are provided, as well as the charging brushes 52 that supply power to the electrodes 36*a* and 36*b*. As illustrated in FIG. 2 and FIG. 4, the charging brush 52 and discharge brush 53 corresponding to the positive electrodes 36*a* are disposed on one side of the transporting belt 31, while the charging brush 52 and discharge brush 53 corresponding to the negative electrodes 36*b* are disposed on the other side of the transporting belt 31.

In the transporting belt 31, the positive and negative electrodes 36*a* and 36*b* formed in the shape of comb teeth extend in a direction intersecting the transporting direction, and are alternately arranged at predetermined intervals. The surface layer 36*d* (see FIG. 3) is partially removed and allows partial exposure of the surfaces of the positive and negative electrodes 36*a* and 36*b* on the respective sides where their corresponding charging brushes 52 and discharge brushes 53 are disposed. These exposed portions, that is, the voltage receiving portions 36*a*' and 36*b*' are accessible by the charging brushes 52 and the discharge brushes 53. In other words, charging and discharging of the positive electrodes 36*a* are performed on one side of the transporting belt 31, while high-voltage charging and discharging of the negative electrodes 36*b* are performed on the other side of the transporting belt 31.

The pressing roller 33 for pressing the transported sheet material P against the transporting belt 31 is disposed at the position facing the driven roller 32 with the transporting belt 31 interposed between the pressing roller 33 and the driven roller 32. The length of the pressing roller 33 extending across the width of the transporting belt 31 is set to be shorter than the distance between the charging brushes 52 on both sides of the transporting belt 31, that is, shorter than the distance between the discharge brushes 53 on both sides of the transporting belt 31. In other words, the pressing roller 33 is configured such that it can be arranged between both sides of the transporting belt 31, each side being defined by the charging brush 52 and discharge brush 53. The configuration can thus be simplified, and it is possible to reduce the number of components.

Figure 6A:
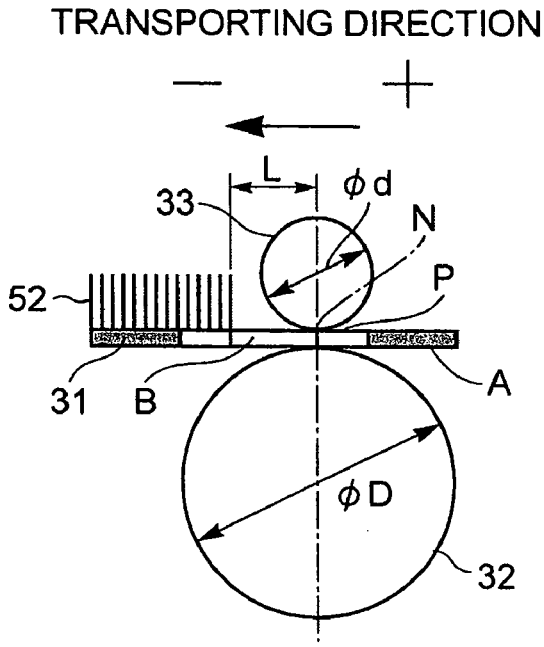
FIG. 6A is a schematic partial side view illustrating a state in which an attraction force is generated when, in the sheet-material transporting device shown in FIG. 2, a distance in the transporting direction from a nip of a pressing roller to the uppermost stream end of a charging brush is equal to the width of each electrode.
Figure 6B:
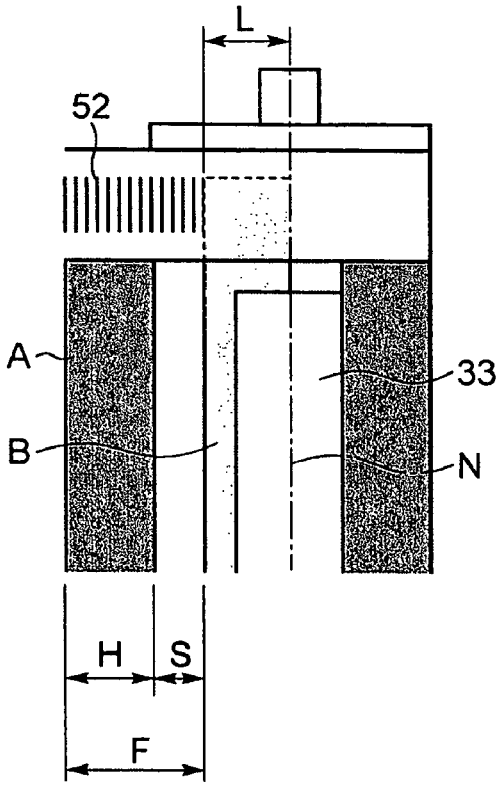
FIG. 6B is a plan view of FIG. 6A.
Figure 7A:
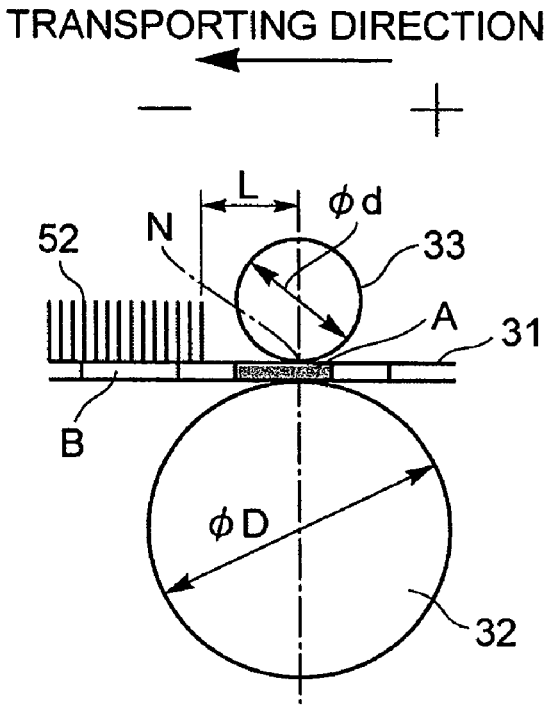
FIG. 7A is a schematic partial side view illustrating a state in which an electrode is moving downstream from the location illustrated in FIGS. 6A and 6B, and the subsequent electrode is approaching the charging brush.
Figure 7B:
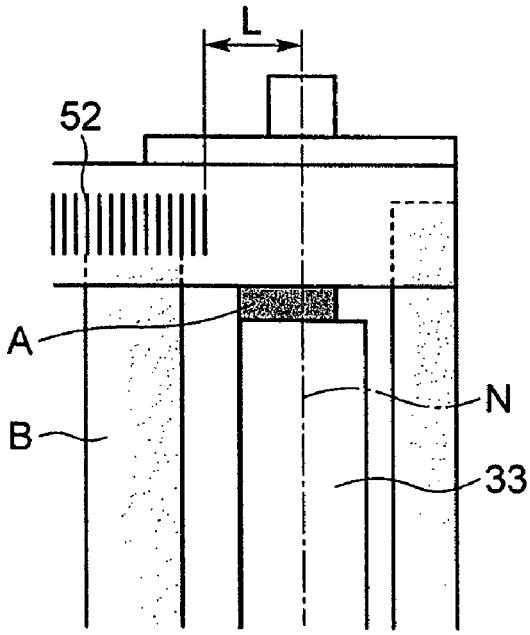
FIG. 7B is a plan view of FIG. 7A.
Figure 8A:
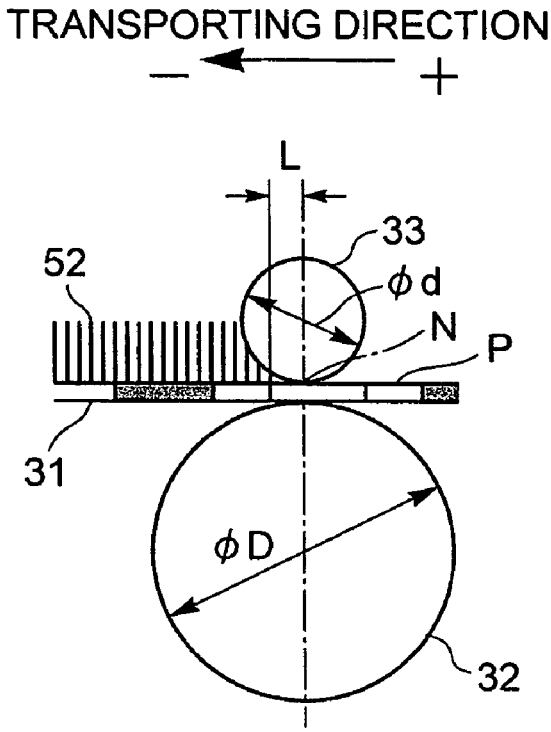
FIG. 8A is a schematic partial side view illustrating a state in which an attraction force is generated when, in the sheet-material transporting device shown in FIG. 2, a distance in the transporting direction from the nip of the pressing roller to the uppermost stream end of the charging brush is smaller than the width of each electrode.
Figure 8B:
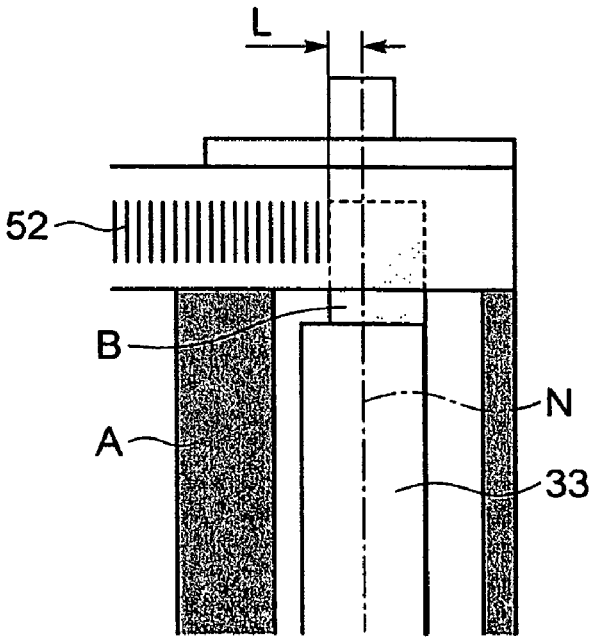
FIG. 8B is a plan view of FIG. 8A.
Figure 9A:
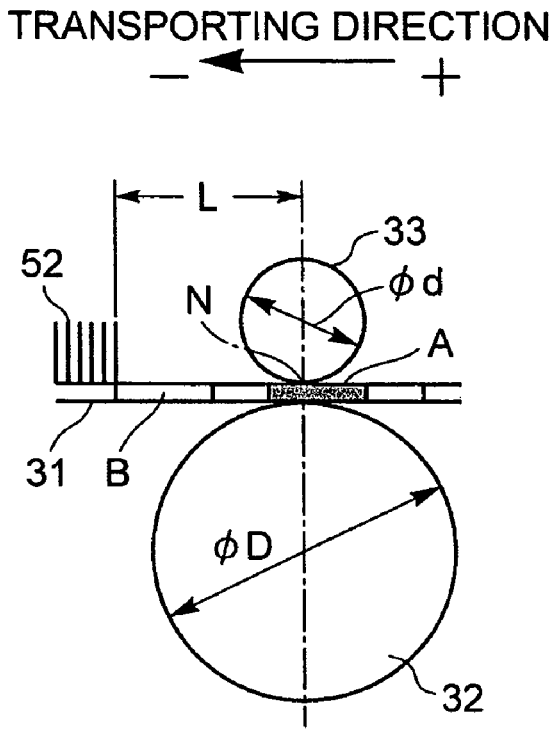
FIG. 9A is a schematic partial side view illustrating a state in which an attraction force is generated when, in the sheet-material transporting device shown in FIG. 2, a distance in the transporting direction from the nip of the pressing roller to the uppermost stream end of the charging brush is longer than the width of each electrode.
Figure 9B:
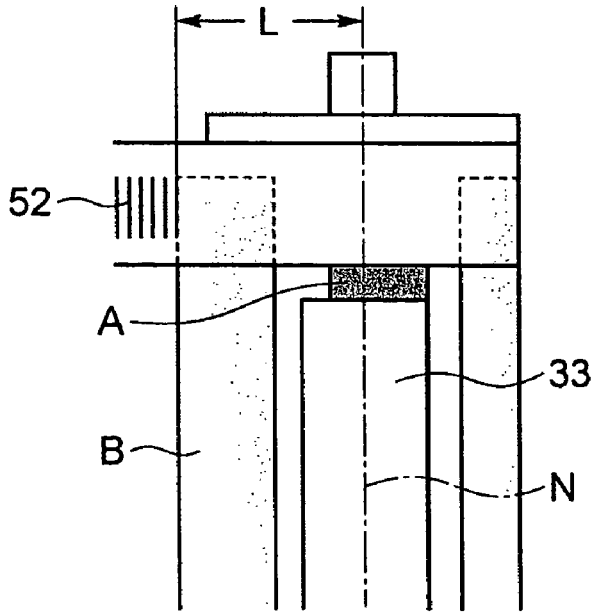
FIG. 9B is a plan view of FIG. 9A.

FIGS. 6A, 7A, 8A, and 9A are schematic side views each illustrating the relationship between the width H of each of the electrodes 36*a* and 36*b* (indicated by "A" and "B" in the drawings), an interelectrode distance S, and the uppermost stream end of a charging brush 52. FIGS. 6B, 7B, 8B, and 9B are plan views of FIGS. 6A, 7A, 8A, and 9A, respectively. FIGS. 6A and 6B illustrate a state in which when a transport distance L from the nip N of the pressing roller 33 to the uppermost stream end of the charging brush 52 is equal to the width H of each electrode (L=H), an attraction force is generated in response to the start of power feeding to a specific electrode (i.e., illustration of a state in an attraction position at the uppermost stream end of the charging brush 52). FIGS. 7A and 7B illustrate a state in which the above-described specific electrode is moving downstream from the location illustrated in FIGS. 6A and 6B, and the subsequent electrode is approaching the charging brush 52. FIGS. 8A and 8B illustrate a state in which when the transport distance L from the nip N of the pressing roller 33 to the uppermost stream end of the charging brush 52 is smaller than the width H of each electrode (L<H), an attraction force is generated in response to the start of power feeding to a specific electrode. FIGS. 9A and 9B illustrate a state in which when the transport distance L from the nip N of the pressing roller 33 to the uppermost stream end of the charging brush 52 is larger than the width H of each electrode (L>H), an attraction force is generated in response to the start of power feeding to a specific electrode.

Next, the timing at which the sheet material P is attracted to the transporting belt 31 will be described with reference to FIGS. 6A through 9B. The diameter ΦD of the driven roller 32 is determined according to the bending properties of the transporting belt 31, the distance between the recording head assembly 7 and the driven roller 32, and the like. In the present exemplary embodiment, the driven roller 32 with a diameter ΦD of about 30 mm is used. While the diameter Φd of the pressing roller 33 will not be specified, the pressing roller 33 with a diameter Φd of about 16 mm is used in the present exemplary embodiment since, from a design point of view, the upper space is limited.

Let "H" be the width of each of the electrodes 36*a* and 36*b* in the transporting belt 31, let "S" be the interelectrode distance, let "F" (F=H+S) be a pitch between two adjacent electrodes, and let "L" be the transport distance between the nip N of the pressing roller 33 and the uppermost stream end of the charging brush 52. The transporting direction upstream of the nip N of the pressing roller 33 is denoted by a plus sign "+", and the transporting direction downstream of the nip N of the pressing roller 33 is denoted by a minus sign "−". As illustrated in FIGS. 6A, 6B, 7A, and 7B, if the condition L=H is true, a specific electrode (light-colored electrode "B" in the drawings) at the attraction-force generating position (attraction starting position) is not located upstream (on the "+" side) of the nip N of the pressing roller 33.

That is, in FIGS. 7A and 7B, the light-colored electrode B is moving downstream in the transporting direction, and a dark-colored electrode A is passing through the nip N and approaching the uppermost stream end of the charging brush 52. Since power feeding does not start until the dark-colored electrode A comes into contact with the uppermost stream end of the charging brush 52, the upstream side of the light-colored electrode B immediately before power feeding to the dark-colored electrode A starts corresponds to a power feeding point located on the lowermost stream side ("−"side). Therefore, if the condition L=H is true, the attraction-force generating position (attraction starting position) varies from 0 (nip N) to −F. In this state, an attraction force is not generated upstream (on the "+" side) of the nip N.

As in FIGS. 8A and 8B, if the transport distance L from the nip N of the pressing roller 33 to the uppermost stream end of the charging brush 52 is smaller than the width H of each electrode (L<H), the attraction-force generating position (attraction starting position) varies from (H−L) to (H−L−F). Since the condition (H−L)>0 is true, an attraction force may be generated upstream (on the "+" side) of the nip N of the pressing roller 33.

As in FIGS. 9A and 9B, if the transport distance L from the nip N of the pressing roller 33 to the uppermost stream end of the charging brush 52 is larger than the width H of each electrode (L>H), the attraction-force generating position varies from (H−L) to (H−L−F). Since the condition [(H−L)<0] is true, an attraction force is not generated upstream (on the "+" side) of the nip N of the pressing roller 33.

To prevent the sheet material P (recording medium) from being attracted to the transporting belt 31 before it reaches the nip N of the pressing roller 33, the condition (L=H) or the condition (L>H) must be satisfied as shown in FIGS. 6A, 6B, 7A, 7B, 9A, and 9B. The configuration where the condition (L<H) is true as in FIGS. 8A and 8B causes an attraction force to be generated upstream (on the "+" side) of the nip N of the pressing roller 33, and thus is outside the scope of the present invention.

In the configuration illustrated in FIGS. 9A and 9B, it may be possible that a distance of |H−L| does not allow an attraction force to be generated and prevents the pressing roller 33 from functioning as intended. Therefore, a distance of |H−L| can be minimized to the greatest degree possible. From this point of view, as illustrated in FIGS. 6A, 6B, 7A, and 7B, the transport distance L from the nip N of the pressing roller 33 to the uppermost stream end of the charging brush 52 is ideally equal to the width H of each electrode (L=H).

In other words, if the transporting belt 31 including the electrodes 36*a* and 36*b* in the shape of comb teeth is configured such that the condition (L<H), which is satisfied by the configuration illustrated in FIGS. 8A and 8B, can be prevented from being satisfied, it is possible to ensure that power feeding starts downstream of the nip N of the pressing roller 33. With the configuration described above, the sheet material P can be prevented from being attracted to the transporting belt 31 before it reaches the nip N of the pressing roller 33. Moreover, the above-described configuration allows the sheet material P to be firmly attracted to the transporting belt 31, thereby improving accuracy in transportation. This prevents degradation in image quality due to the occurrence of dot shift or the like, and thus ensures stable and high quality images.

According to the exemplary embodiment described above, the sheet-material transporting device includes the transporting belt 31 configured to transport the sheet material P while attracting it with the electrodes 36*a* and 36*b* extending in a direction intersecting the transporting direction and arranged at predetermined intervals; the pressing roller 33 configured to press the sheet material P against the transporting belt 31 at an attraction starting position; and the charging brushes (charging units) 52 configured to apply a voltage to the electrodes 36*a* and 36*b*, and is configured such that the sheet material P is prevented from being attracted to the transporting belt 31 before the leading edge of the sheet material P is pressed against the transporting belt 31 by the pressing roller 33. Alternatively, in the sheet-material transporting device including the components described above, the charging brushes 52 are arranged such that power feeding does not start upstream of the nip N of the pressing roller 33 in the transporting direction.

With the configuration described above, since an attraction force is not exerted on the sheet material P upstream of the pressing roller 33 in the transporting direction, the sheet material P can be transported with high precision while being firmly attracted to the transporting belt 31. Therefore, it is possible to provide the sheet-material transporting device and the image forming apparatus including the sheet-material transporting device that can prevent degradation in image quality due to the occurrence of dot shift or the like and can ensure stable and high quality images. Specifically, since it is possible to prevent correction for the skew of sheet material from being interrupted due to a deviation in the timing of attraction-force generation upstream of the pressing roller, the skew of the sheet material can be prevented from occurring again. It is also possible to prevent that when, for example, sheet material is warped upward in the middle, both sides of the sheet material are first attracted to the transporting belt and thus wrinkles occur in the middle of the sheet material.

Figure 10:
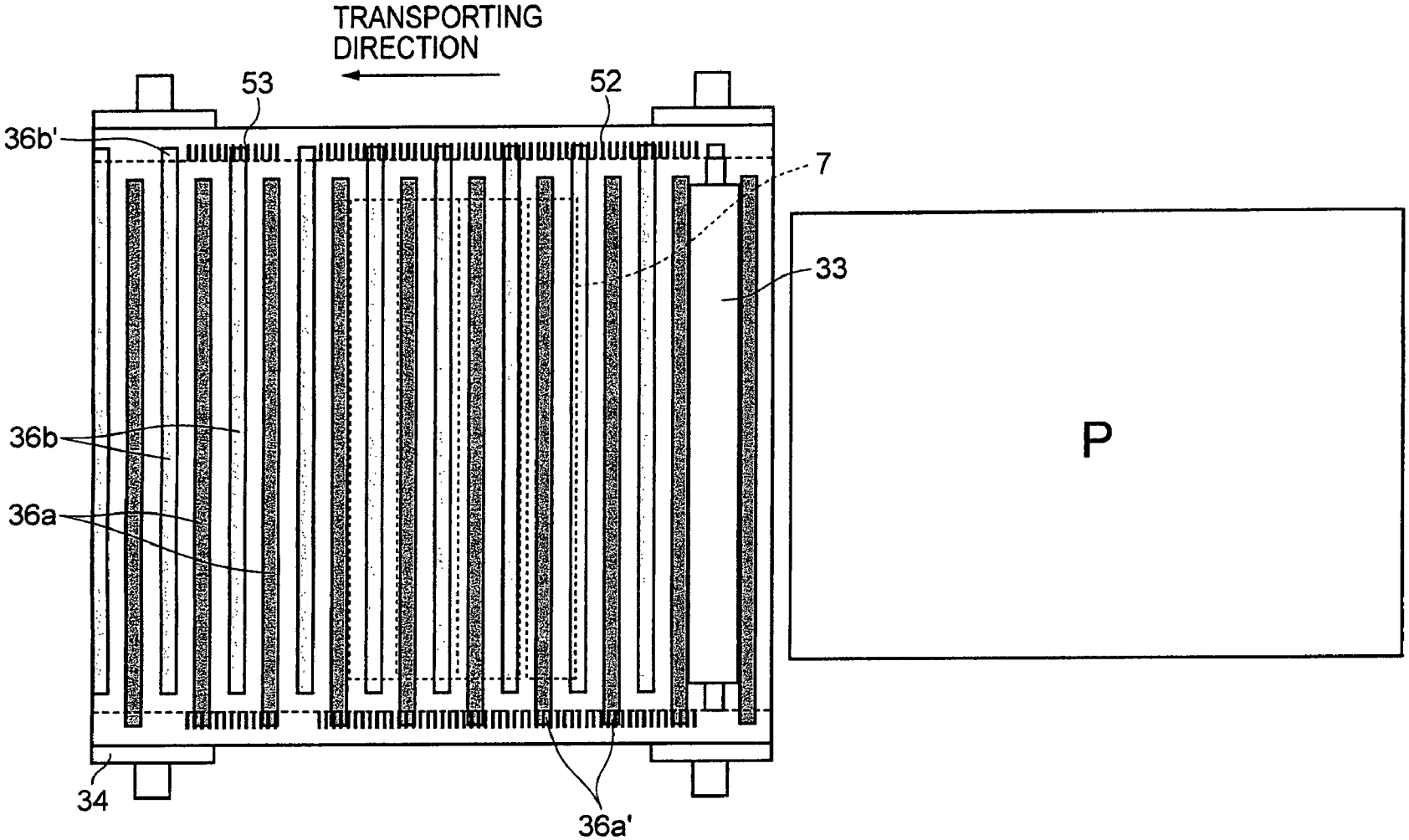
FIG. 10 is a schematic plan view illustrating a second exemplary embodiment of the sheet-material transporting device according to the present invention.
Figure 11:
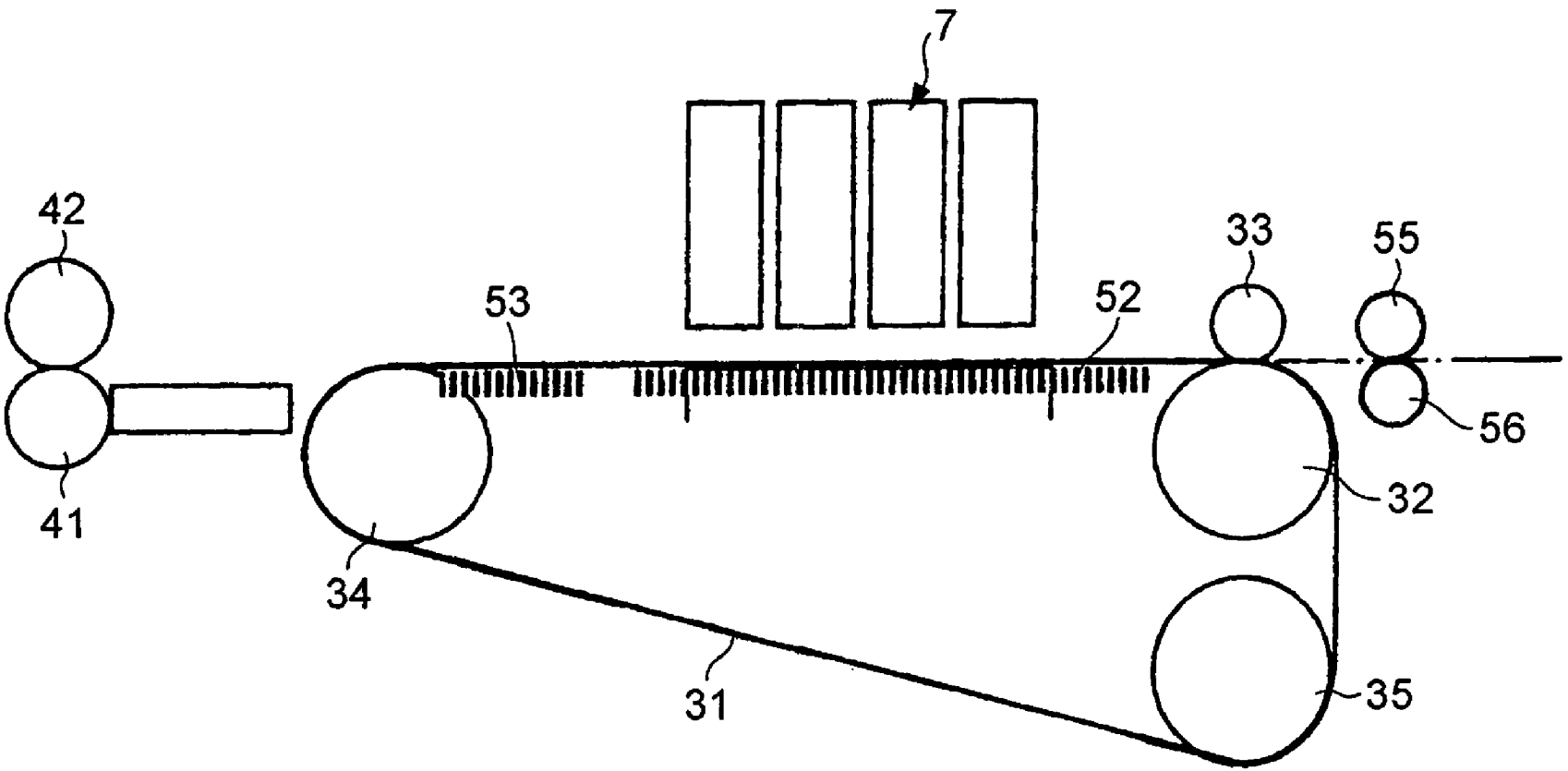
FIG. 11 is a schematic side view of the sheet-material transporting device illustrated in FIG. 10.
Figure 12A:
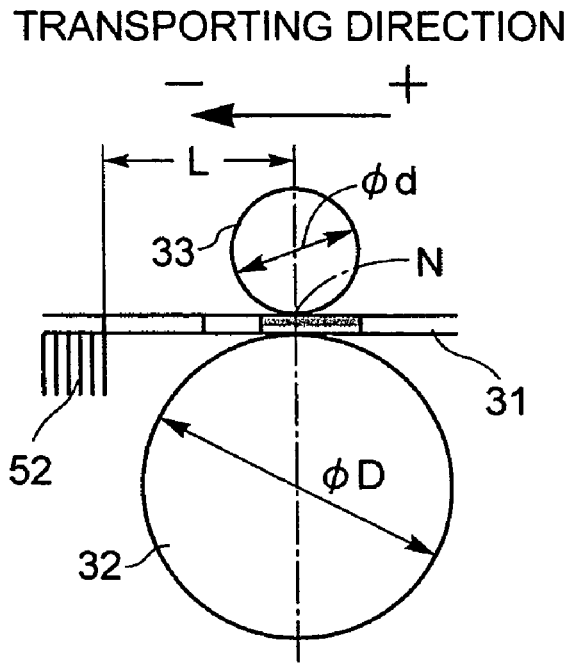
FIG. 12A is a schematic partial side view illustrating a state in which, in a second exemplary embodiment, an attraction force is generated in response to the start of power feeding to a specific electrode.
Figure 12B:
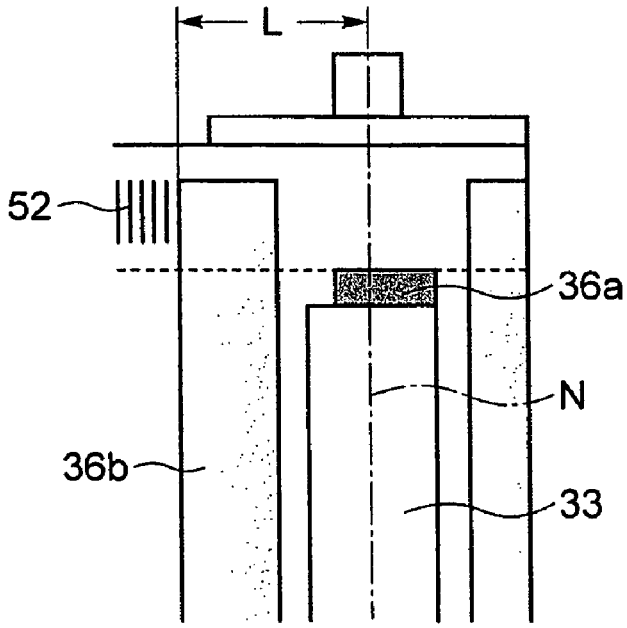
FIG. 12B is a plan view of FIG. 12A.
Figure 13A:
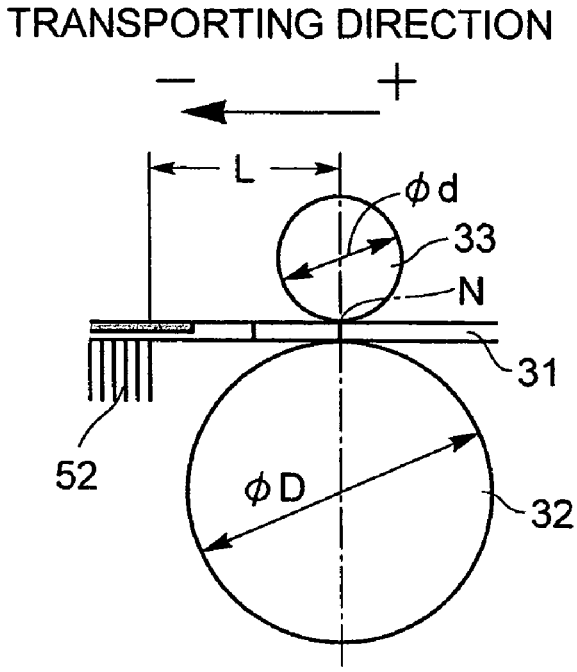
FIG. 13A is a schematic partial side view illustrating a state in which, in a modified second exemplary embodiment, an attraction force is generated in response to the start of power feeding to a specific electrode.
Figure 13B:
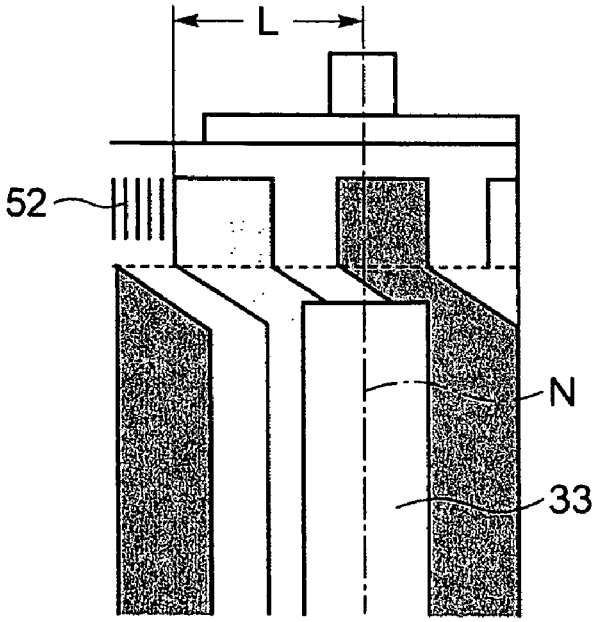
FIG. 13B is a plan view of FIG. 13A.
Figure 14A:
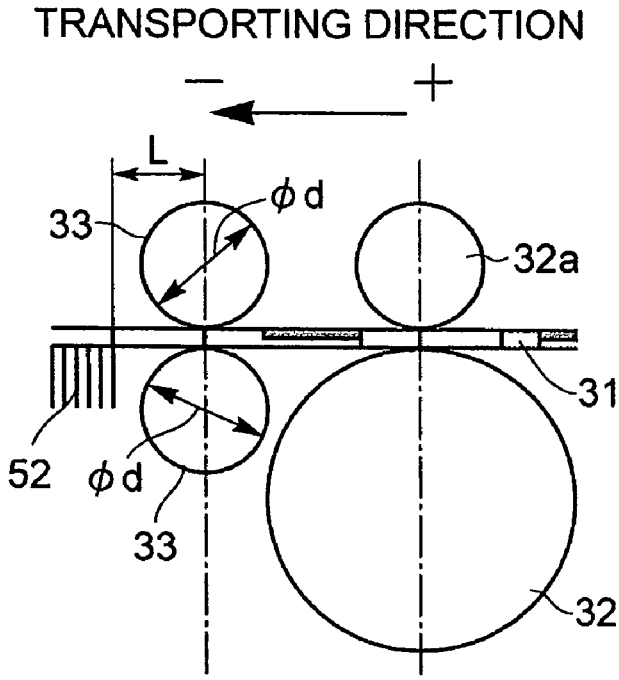
FIGS. 14A and 14B illustrate a state in which, in another modified second exemplary embodiment where a pressing roller assembly composed of a pair of rollers is disposed downstream of a driven roller, the pair of rollers facing each other with the transporting belt interposed therebetween, an attraction force is generated in response to the start of power feeding to a specific electrode.
Figure 14B:
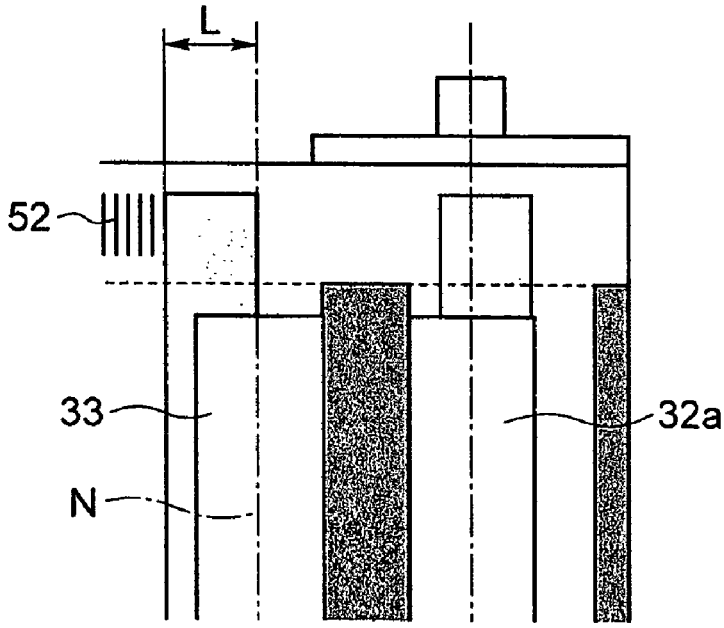
Figure 15:
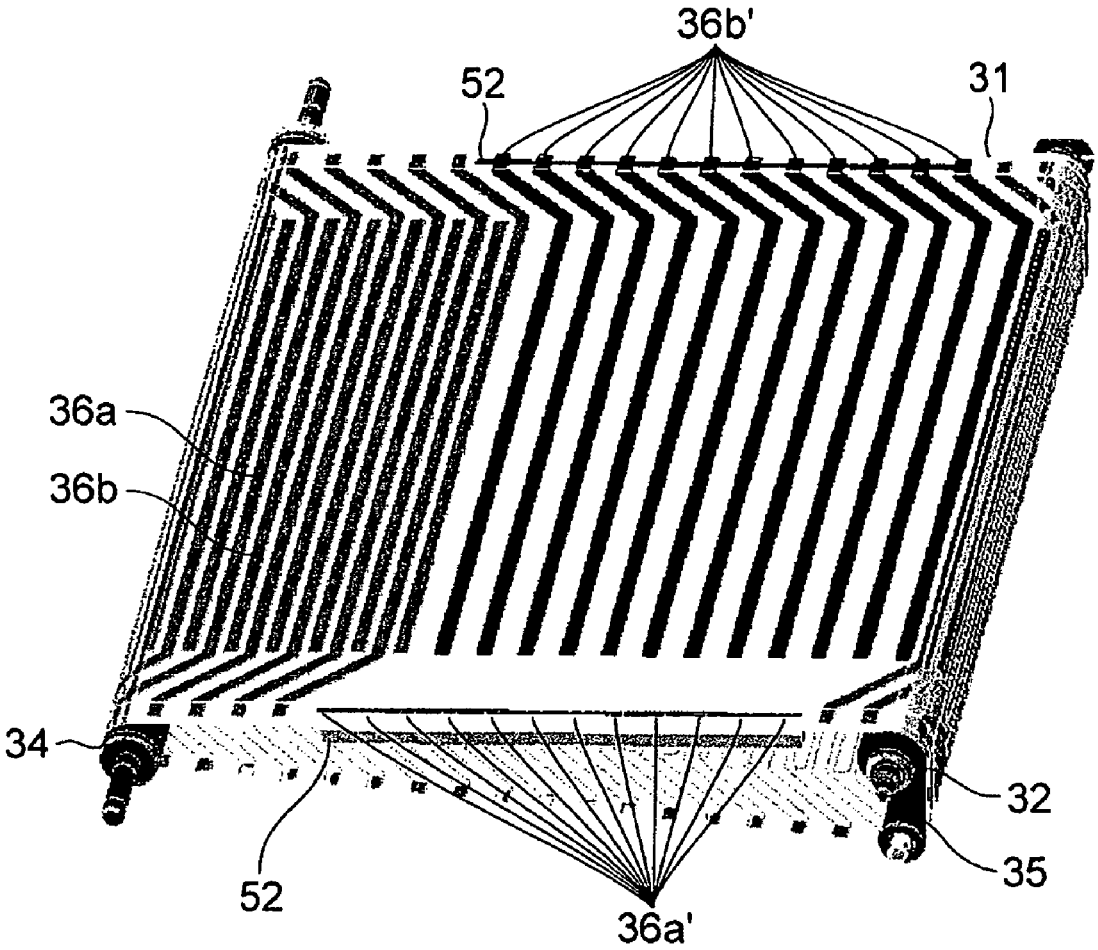
FIG. 15 is a schematic perspective view illustrating the modified second exemplary embodiment of the sheet-material transporting device in FIGS. 13A and 13B in which a pattern of electrodes is modified.
Figure 16:
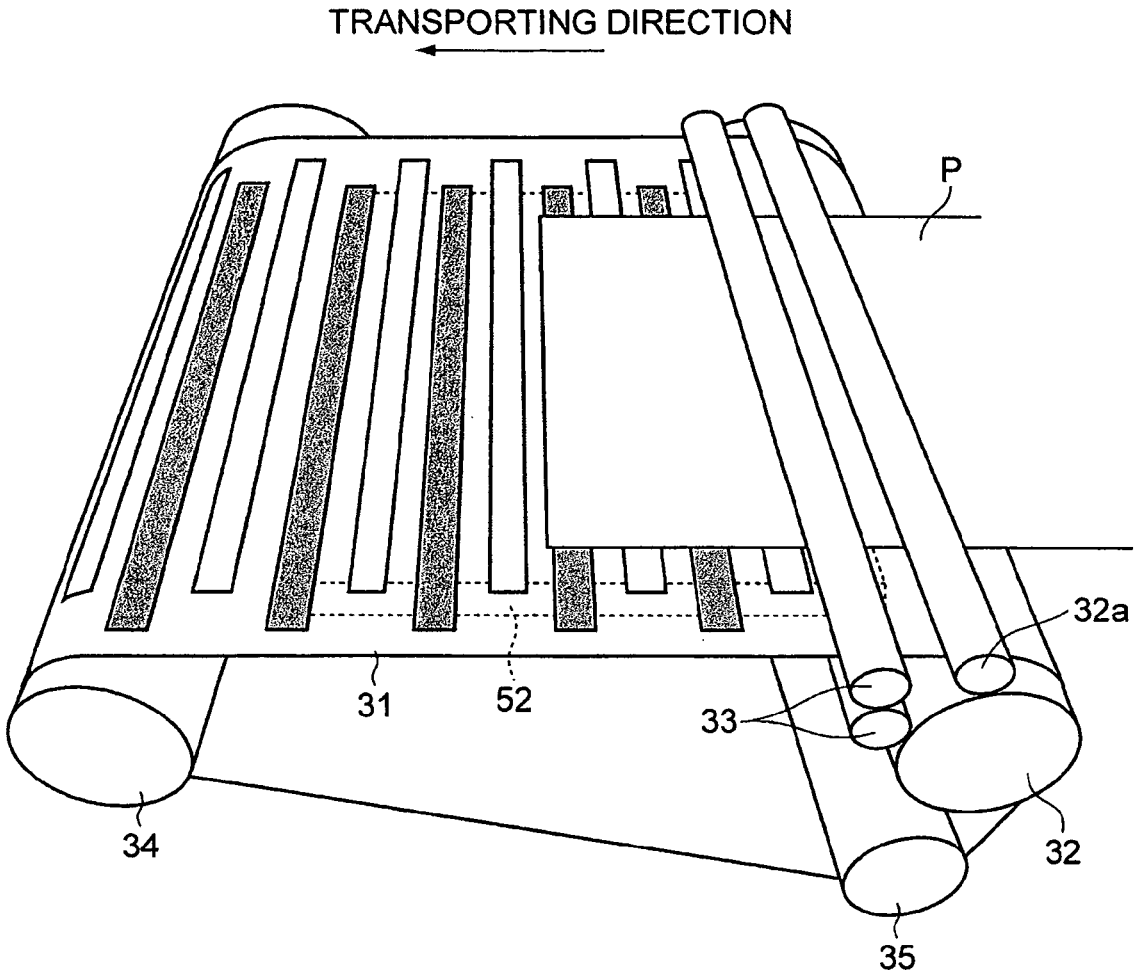
FIG. 16 is a schematic perspective view illustrating the modified second exemplary embodiment of the sheet-material transporting device in FIGS. 14A and 14B in which the configuration of the pressing roller is modified.

FIG. 10 is a schematic plan view illustrating a second exemplary embodiment of the sheet-material transporting device according to the present invention. FIG. 11 is a schematic side view of the sheet-material transporting device illustrated in FIG. 10. FIGS. 12A, 13A, and 14A are schematic side views each illustrating the relationship between the width H of each of the electrodes 36*a* and 36*b*, an interelectrode distance S, and the uppermost stream end of a charging brush 52. FIGS. 12B, 13B, and 14B are plan views of FIGS. 12A, 13A, and 14A, respectively. FIG. 15 is a schematic perspective view illustrating the modified second exemplary embodiment of the sheet-material transporting device in FIGS. 13A and 13B in which a pattern of electrodes is modified. FIG. 16 is a schematic perspective view illustrating the modified second exemplary embodiment of the sheet-material transporting device in FIGS. 14A and 14B in which the configuration of the pressing roller is modified.

FIGS. 12A and 12B illustrate a state in which when a transport distance L from the nip N of the pressing roller 33 to the uppermost stream end of the charging brush 52 is equal to the width H of each electrode (L=H), or larger than the width H of each electrode (L>H), an attraction force is generated in response to the start of power feeding to a specific electrode. FIGS. 13A and 13B illustrate a state in which, in the transporting belt 31 configured such that a sheet-material attracting part of each electrode is located upstream of its voltage receiving portion, with the charging brush 52 being arranged as in FIGS. 12A and 12B, an attraction force is generated in response to the start of power feeding to a specific electrode. FIGS. 14A and 14B illustrate a state in which, in a modified second exemplary embodiment where a pressing roller assembly composed of a pair of pressing rollers 33 and 33 is disposed downstream of the driven roller 32, the pair of pressing rollers 33 facing each other with the transporting belt 31 interposed therebetween, an attraction force is generated in response to the start of power feeding to a specific electrode.

The present exemplary embodiment differs from the first exemplary embodiment in that the charging brushes 52 and the discharge brushes 53 are arranged opposite the recording head assembly 7 with the transporting belt 31 interposed therebetween, that is, the charging brushes 52 and the discharge brushes 53 are arranged on the underside of the transporting belt 31. This configuration not only prevents ink from entering the space between the electrodes (voltage receiving portions), but also has an effect of reducing the width of the image forming apparatus. The second exemplary embodiment illustrated in FIGS. 10 and 11 differs from the first exemplary embodiment in the respects described above. In the other respects, the second exemplary embodiment has similar configuration to that of the first exemplary embodiment, and thus can achieve similar effects to those of the first exemplary embodiment.

In general, the diameter ΦD of the driven roller 32 is set to be relatively large. However, in the present exemplary embodiment, if the diameter ΦD of the driven roller 32 is large, the charging brushes 52 cannot be placed near the nip of the driven roller 32. For example, when the diameter ΦD of the driven roller 32 is about 30 mm, the width H of each of the electrodes 36*a* and 36*b* is about 10 mm, and the interelectrode distance S is about 5 mm, if as in FIGS. 9A and 9B the transport distance L from the nip N of the pressing roller 33 to the uppermost stream end of a charging brush 52 is larger than the width H of each electrode (L>H), the sheet material P is transported about 5 mm without being supplied with electric power, and thus without being attracted to the transporting belt 31. The sheet material P is transported a maximum of about 15 mm without being attracted to the transporting belt 31.

In the present exemplary embodiment where the charging brushes 52 and the discharge brushes 53 are disposed on the inner surface (underside) of the transporting belt 31, the electrode pattern can be configured as illustrated in FIGS. 13A, 13B, and 15. That is, with the electrode pattern where sheet-material attracting areas of the electrodes 36*a* and 36*b* are located upstream, in the transporting direction, of their corresponding voltage receiving portions 36*a*' and 36*b*', it is possible to configure such that the attraction-force generating position is located upstream of the points that are in contact with the charging brushes 52. The condition (H−L=0) is true in this configuration. Thus, as in the case of the first exemplary embodiment illustrated in FIGS. 6A, 6B, 7A, and 7B, it is possible to achieve a sheet-material transporting device that can prevent the sheet material P from being attracted to the transporting belt 31 before it reaches the nip N of the pressing roller 33.

In the exemplary embodiment illustrated in FIGS. 14A, 14B, and 16, the charging brushes 52 are disposed on the inner surface (back surface) of the transporting belt 31 including linear electrodes in the shape of comb teeth. A sub-driven roller (sub-transporting roller) 32*a* is disposed opposite the driven roller 32 with the transporting belt 31 interposed therebetween, while the pressing roller assembly composed of the pair of pressing rollers 33 and 33 is disposed a predetermined distance downstream of the driven roller 32. The pressing rollers 33 face each other with the transporting belt 31 interposed therebetween.

As illustrated in FIGS. 14A and 14B, the pressing roller assembly is configured such that the relationship between the diameter Φd of the pressing roller 33 on the underside (back side) of the transporting belt 31 and the width H of the electrodes 36*a* and 36*b* can be expressed as "Φd/2<H". With this configuration, it is possible to achieve the above-described state that allows the condition "H−L=0" or "H−L<0". In other words, it is possible to prevent the sheet material P from being attracted to the transporting belt 31 before it reaches the nip N of the pressing roller assembly. Thus, the exemplary embodiment illustrated in FIGS. 14A, 14B, and 16, as well as that illustrated in FIGS. 13A, 13B, and 15, have similar effects to those of the first exemplary embodiment.

With the exemplary embodiments described above, it is possible to eliminate the conventional disadvantages in which correction for the skew of sheet material performed by the correction rollers is interrupted when the leading edge of the sheet material is attracted to the transporting belt before it reaches the pressing roller and thus the sheet material skews again. It is also possible to eliminate the conventional disadvantages in which, when sheet material is warped upward in the middle, both sides of the sheet material are first attracted to the transporting belt and thus wrinkles occur in the middle of the sheet material. In other words, with the exemplary embodiments described above, since an attraction force is not exerted on the sheet material upstream of the pressing roller in the transporting direction, the sheet material can be transported with high precision while being firmly attracted to the transporting belt 31. The present invention thus can provide an image forming apparatus that includes the sheet-material transporting device and is thus capable of preventing degradation in image quality due to the occurrence of dot shift or the like and producing stable and high quality images.

To achieve high-speed and high-definition recording, main droplets of ink are being made finer in recent years. This accelerates the technical tendency to reduce the distance between the recording medium and the recording head and to increase ink ejection speed. Therefore, to achieve high-definition image quality, it is necessary to transport a recording medium with high precision while maintaining a small and constant distance between a recording medium and a recording head. The above-described exemplary embodiments that allow for high-precision transport of a recording medium while ensuring a reliable attraction of the recording medium are particularly effective for a one-pass high-speed recording apparatus with a line head, since degradation in transport precision may directly affect image quality.

In the exemplary embodiments, an image forming apparatus with a line-type image forming unit, such as a full-line head, has been described as an exemplary application of the present invention. However, the present invention is also applicable to an image forming apparatus using a different recording method, such as a serial-type image forming apparatus with an image forming unit moving across sheet material for main scanning, and produces similar effects. In the exemplary embodiments, an inkjet image forming apparatus has been described as an exemplary application of the present invention. However, the present invention is applicable to other types of image forming apparatuses regardless of the method of recording and produces similar effects. For example, the present invention is applicable to image forming apparatuses using recording methods such as thermal transfer, thermal recording, laser-beam irradiation, and wire dot recording.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-143552 filed May 17, 2005, which is hereby incorporated by reference herein in its entirety.

What is claimed is:

1. A sheet-material transporting device comprising:

a transporting belt configured to attract a sheet material and transport the sheet material along a transporting direction, the transporting belt including a plurality of electrodes arranged at predetermined intervals along the transporting direction, wherein the electrodes are sized and shaped extending in a direction intersecting the transporting direction;

a pressing roller configured to press the sheet material against an attraction starting position of the transporting belt;

a pair of rollers, disposed upstream of the pressing roller, that correct the skew of the sheet material; and a charging unit configured to apply a voltage to the electrodes, wherein the application of the voltage to the electrodes does not generate an attraction force, between the transporting belt and the sheet material, upstream of a nip of the pressing roller, wherein the sheet material is attracted to the transporting belt after the leading edge of the sheet material is pressed against the transporting belt by the pressing roller, and wherein a transport distance from the nip of the pressing roller to an uppermost stream end of the charging unit is equal to or larger than a width of each electrode.

2. The sheet-material transporting device according to claim 1, wherein the charging unit includes a pair of charging brushes having a resistance of about $1\times10^6$ ohm-cm, and wherein a sheet-material attracting area of the transporting belt is controlled by varying a length and position of the charging brushes to change a power feed area of the charging brushes.

3. The sheet-material transporting device according to claim 1, wherein the charging unit is disposed on a surface opposite a sheet-material attracting surface of the transporting belt.

4. The sheet-material transporting device according to claim 1, wherein each electrode includes a voltage receiving portion and a sheet-material attracting part located upstream with respect to the voltage receiving portion in the transporting direction.

5. An image forming apparatus comprising:

an image forming unit configured to form an image on sheet material on the basis of image information; and the sheet-material transporting device according to claim 1.

6. The image forming apparatus according to claim 5, further comprising a platen disposed opposite the image forming unit with the transporting belt interposed therebetween, the platen being configured to hold the transporting belt flat.

7. The image forming apparatus according to claim 5, wherein the image forming unit includes an inkjet recording head configured to eject ink onto the sheet material.

8. The image forming apparatus according to claim 5, wherein an upstream end, in the transporting direction, of a sheet-material attracting area of the transporting belt is located upstream of an ink ejection position on the uppermost stream side, in the transporting direction, of the image forming unit.

9. The image forming apparatus according to claim 5, wherein the image forming unit includes a line-type recording head extending in a direction intersecting the transporting direction.

10. A sheet-material transporting device comprising:

a transporting belt configured to attract a sheet material and transport the sheet material along a transporting direction, the transporting belt including a plurality of electrodes arranged at predetermined intervals along the transporting direction, wherein the electrodes are sized and shaped extending in a direction intersecting the transporting direction;

a pressing roller configured to press the sheet material against an attraction starting position of the transporting belt;

a pair of rollers, disposed upstream of the pressing roller, that correct the skew of the sheet material; and a charging unit configured to apply a voltage to the electrodes, wherein the charging unit is configured such that the voltage is not applied upstream of a nip of the pressing roller in the transporting direction such that an attraction force, between the transporting belt and the sheet material, is not generated upstream of the nip of the pressing roller, and wherein a transport distance from the nip of the pressing roller to an uppermost stream end of the charging unit is equal to or larger than a width of each electrode.

11. The sheet-material transporting device according to claim 10, wherein the charging unit includes a pair of charging brushes having a resistance of about $1\times10^6$ ohm-cm, and wherein a sheet-material attracting area of the transporting belt is controlled by varying a length and position of the charging brushes to change a power feed area of the charging brushes.

12. The sheet-material transporting device according to claim 10, wherein the charging unit is disposed on a surface opposite a sheet-material attracting surface of the transporting belt.

13. The sheet-material transporting device according to claim 10, wherein each electrode includes a voltage receiving portion and a sheet-material attracting part located upstream with respect to the voltage receiving portion in the transporting direction.

14. An image forming apparatus comprising:

an image forming unit configured to form an image on sheet material on the basis of image information; and the sheet-material transporting device according to claim 10.

15. The image forming apparatus according to claim 14, further comprising a platen disposed opposite the image forming unit with the transporting belt interposed therebetween, the platen being configured to hold the transporting belt flat.

16. The image forming apparatus according to claim 14, wherein the image forming unit includes an inkjet recording head configured to eject ink onto the sheet material.

17. The image forming apparatus according to claim 14, wherein an upstream end, in the transporting direction, of a sheet-material attracting area of the transporting belt is located upstream of an ink ejection position on the uppermost stream side, in the transporting direction, of the image forming unit.

18. The image forming apparatus according to claim 14, wherein the image forming unit includes a line-type recording head extending in a direction intersecting the transporting direction.

* * * * *